United States Patent [19]

Larson et al.

[11] 4,063,663

[45] Dec. 20, 1977

[54] POWDERED DETERGENT DISPENSER

[75] Inventors: Spencer Brian Larson, South St. Paul; Duane Leroy Salmonson, West St. Paul, both of Minn.

[73] Assignee: Economics Laboratory, Inc., St. Paul, Minn.

[21] Appl. No.: 640,638

[22] Filed: Dec. 15, 1975

[51] Int. Cl.[2] ..... B67D 5/08

[52] U.S. Cl. ..... 222/52; 23/267 E; 222/67; 222/185; 222/189

[58] Field of Search ..... 222/52, 67, 189, 185, 222/193; 23/267 R, 267 A, 267 B, 267 E; 141/9; 200/61, 62; 68/12 R; 134/57 DL, 58 DL, 93

[56] References Cited

U.S. PATENT DOCUMENTS

| | | | |
|---|---|---|---|
| Re. 20,262 | 2/1937 | Lane | 141/9 |
| 1,978,753 | 10/1934 | Lent | 222/52 X |
| 2,478,814 | 8/1949 | Ferris | 134/57 DL |
| 3,111,830 | 11/1963 | Low | 68/12 R |
| 3,574,561 | 4/1971 | Nickerson et al. | 23/267 E |
| 3,595,438 | 7/1971 | Daley et al. | 222/67 |

OTHER PUBLICATIONS

The American College Dictionary, Barnhardt, 1970, p. 255.

*Primary Examiner*—Robert B. Reeves
*Assistant Examiner*—Fred A. Silverberg
*Attorney, Agent, or Firm*—Charles E. Golla

[57] ABSTRACT

A non-hazardous dispenser apparatus for converting powdered detergent, including those containing active chlorine, into a concentrated detergent solution for use by a washing machine. A curved screen member retainably supports a mass of powdered detergent thereabove within a generally cylindrical container configured for mounting to the side wall of a washing machine adjacent the detergent solution carrying reservoir thereof. A single spray-forming nozzle is mounted within the container and below the curved screen for directing a uniform spray of water at substantially the entire downwardly facing concave surface of the screen member. Only that detergent carried immediately above the screen member is wetted by the spray and passes in solution through the screen, after which it is collected and directed by a collecting portion of the container, into the washing machine reservoir. Spray control means, either manual or electronic, controls the spray of water through the nozzle in response to the concentration level of detergent within the washing machine reservoir. The container is loaded through an upper access port normally closed by a door member. Safety switch means disables spray from the nozzle whenever the door member is open.

15 Claims, 7 Drawing Figures

FIG. 1
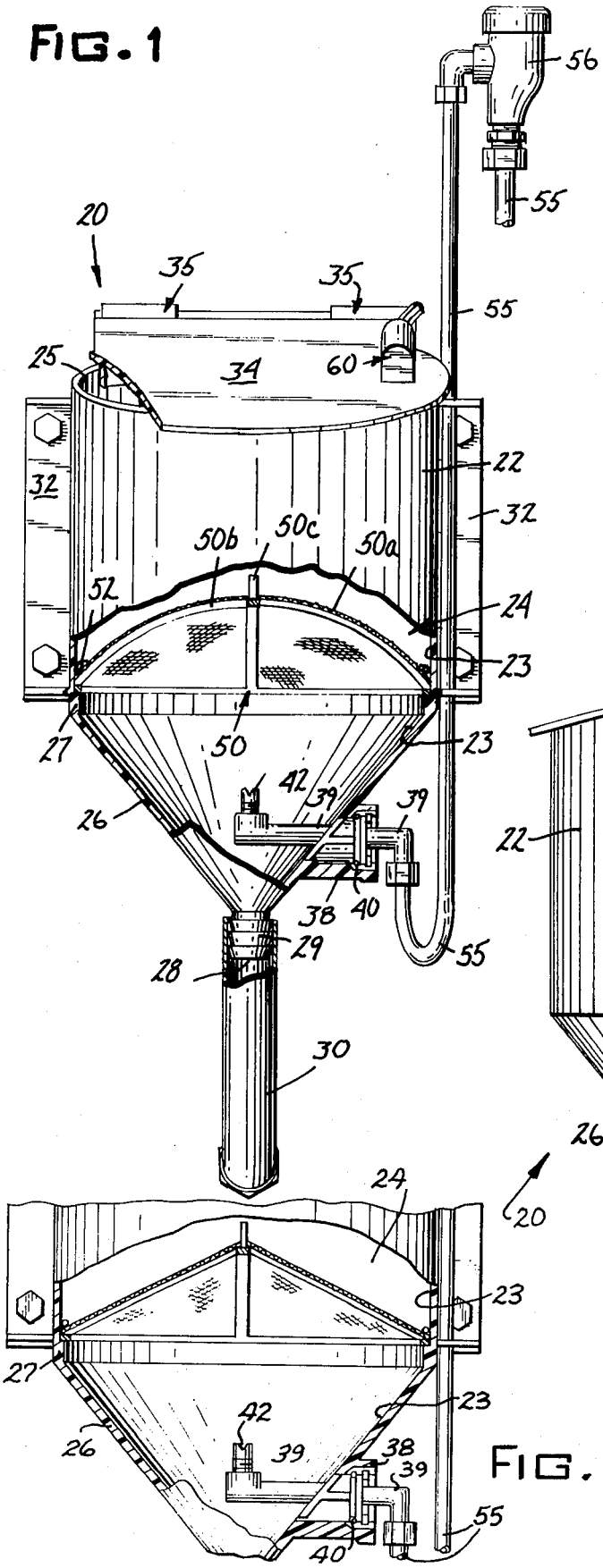
FIG. 1a
FIG. 2
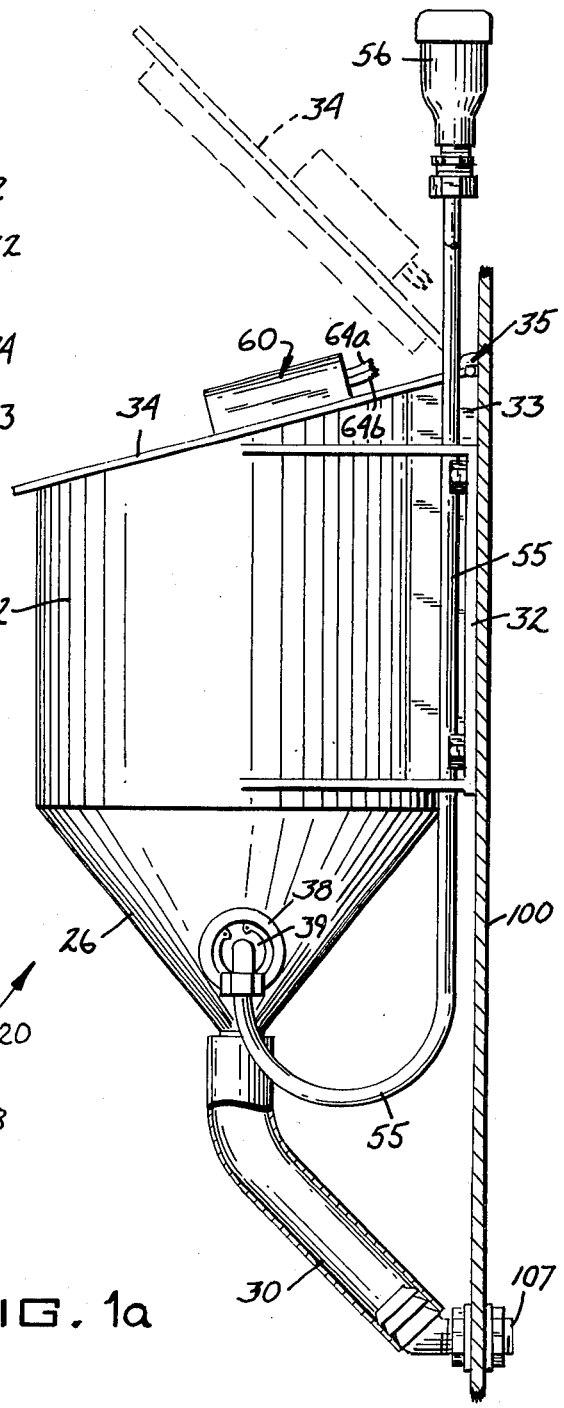

POWDERED DETERGENT DISPENSER

BACKGROUND OF THE INVENTION

1. Field of the Invention

This invention relates generally to dispensers and more particularly to powdered detergent dispensers for washing machines.

2. Description of the Prior Art

Automated washing machines used in commercial applications have typically used powdered detergents and consume large amounts of such detergents in the course of their daily operations. It is advantageous from both time and cost standpoints for the operators of such machines to only periodically supply the machine with powdered detergent, say for example, only once during a working day. Accordingly, commercial washing machines have typically been designed for use with auxiliary detergent dispensers capable of holding sizable amounts of powdered detergent and operable to periodically convert the detergent to concentrated detergent solution as needed for use by the washing machine Such washing machines are generally configured to embody at least one wash tank or reservoir for maintaining a supply of detergent solution for use by the washing machine. The washing machine repeatedly uses the detergent solution within the reservoir for a period of time, such as one day, until it is replaced by a new solution. During normal usage, a certain amount of the detergent solution is drained off, for example with food particles and grease in dishwashing applications, to keep the remaining solution as clean as possible. Water is then added to the reservoir to maintain the proper level. This reduces the concentration of the solution in the reservoir. In order to keep the detergent solution in the reservoir at the proper concentration, concentrated detergent solution is periodically added to the reservoir by the auxiliary detergent dispenser.

Use of an automated detergent dispenser system eliminates the need of constant operator attention to the status of the reservoir solution and provides greater accuracy in maintaining the actual concentration level of the detergent solution within the reservoir.

Many automatic auxiliary detergent dispensing systems have appeared in the prior art. Such dispensers can be generally charactertized by: (1) those dispensing systems which are remotely located (usually in a different physical location) from the washing machine proper, and (2) those dispensing systems which are configured for mounting to or directly adjacent the washing machine proper. The remotely located dispensers are typically configured for handling large 30 to 50 gallon shipping containers of powdered detergent and for directly converting the detergent within these containers into a concentrated detergent solution. Dispensers of this type have selfcontained reservoirs for maintaining a supply of the concentrated solution produced, and a pump for transferring on demand the concentrated solution from the dispenser reservoir to the wash tank of the washing machine proper. In general, such apparatus requires considerable space oftentimes not available on the premises where the washing machine is located, are somewhat cumbersome to use since large shipping containers must be handled by the operator, and do not generally lend themselves to efficient use with smaller or occasionally used washing machines. Dispensers within the second-listed catagory, and to which this invention pertains are much smaller than their remotely located counterparts, and are sized to hold relatively smaller amounts of detergent, thus enabling ease of loading by a wide range of machine operators. Such dispensers can be readily mounted in out-of-the-way positions directly to the washing machine proper, typically on top of the washing machine, and are generally more versatile in their application then the remotely located dispensers. These dispensers are generally loaded from the top and directly supply the adjacent washing machine reservoir with their produced detergent solution by gravity feed, thus eliminating the need and expense for pump means and providing an added dimension of reliability.

Most prior art dispensers of the type which are connected directly to the washing machine have been configured for mounting on top of the machine or within the chassis of the machine generally overlying the wash tank or reservoir. In such dispensers, it has been commonplace to totally immerse the detergent powder in water to form a saturated solution or slurry. A stand pipe usually located in the middle of the dispenser holding tank or pot, maintains a constant water level within the dispenser. When the washing machine requires additional detergent solution for the wash tank, a controller opens a solenoid valve which causes water to flow into the dispenser pot. The added water causes a portion of the saturated solution in the pot to flow into the stand pipe and to fall directly into the underlying wash tank. When the detergent concentration level in the wash tank attains a predetermined level of concentration, the controller shuts off the water supply to the dispenser by closing the solenoid valve. A drawback of the above-described device is that since the detergent is always saturated, the concentration level of the detergent solution produced by the dispenser over a period of time will vary as the detergent solution within the dispenser pot is diluted. Further, such apparatus cannot be used with powdered detergents containing active chlorine, since most of the chlorine contained in such detergents is lost through decomposition once the detergent is wetted.

Such top mounted dispensers are also dangerous to an operator responsible for loading powdered detergent into the dispenser pot. Due to the position of the dispenser over the washing machine, the heat from the machine raises the solution temperature within the dispenser pot to near the wash temperature (i.e. approximately 150° to 160° Fahrenheit). When caustic containing compounds are rapidly added to the dispenser pot, the heat of hydration may cause the solution to boil, presenting a hazardous situation to the operator. This hazard is increased by the fact that due to the top mounting of such dispensers, the operator is required to load such apparatus at or above eye level, thus increasing the danger of caustic splash or spray to his face and eyes.

In an effort to avoid many of the above problems, some dispensers have been configured so as to support a mass of powdered detergent within a large inverted container over a screen mesh and so as to form a detergent solution by wetting the powdered detergent by means of a spray directed through the screen. Such dispenser construction has been successfully used with the large remotely located type of dispensers which employ an underlying reservoir and a pump for forwarding the prepared solution to the washing machine. While some of these principles have been applied to dispensers of the type mounted on or adjacent to the washing machine, none of the prior art dispensers of this type offer that combination of features which solve all of the above problems in a manner that is completely non-hazardous to the attending operator. One example, of such a prior art dispenser theoretically mountable to a washing machine, supports a mass of powdered detergent on a conical screen suspended within a top loading housing. The carried detergent is dissolved by means of a spray of water directed against the convexly shaped surface area of the screen.

While this device solves many of the prior art problems associated with such machine mounted dispensers, its design enables excessive penetration of the spray into the detergent, causing extensive hydration thereof, making this device unattractive for use with active chlorine containing detergents. Further, this dispenser does not include any safety features for protecting an operator loading the dispenser.

The present invention overcomes the above-mentioned shortcomings of the prior art powdered detergent dispensers of the type configured for mounting on or adjacent the washing machine. The dispenser apparatus of the present invention provides a simple non-hazardous and reliable technique for producing highly concentrated detergent solution for use on a demand basis by an attached or adjacent washing machine, produces such solutions which are of substantially uniform composition and concentration throughout the conversion of the entire contents within the detergent dispenser, and minimizes waste due to unusable residues remaining in the dispensing container. The configuration of the dispenser container enables the dispenser to be mounted on the side wall of the washing machine at a level so as to enable ease of operator loading and at a height which does not present a direct hazard to the face and eyes of the operator. Further, automatic safety features of the invention disable operation of the dispenser spray apparatus whenever the loading port is opened by an operator.

SUMMARY OF THE INVENTION

The present invention includes a housing member particularly suitable for attachment to the side wall of a washing machine or to a vertical wall adjacent the washing machine. The housing member includes an upper cylindrical-storage portion for retainably holding a mass of powdered detergent, and defines an upwardly disposed mouth or access port through which powdered detergent is loaded into the housing. The access port is normally covered by means of a door member pivotally mounted to the housing. The lower portion of the housing member is configured in a funnel shaped collector portion downwardly converging to an outlet port. The housing member is designed for mounting such that the vertical height of the outlet port from the collector portion of the housing is higher than that of the wash tank or reservoir of the washing machine. A conduit is connected to the outlet port of the housing member for directing detergent solution therethrough by means of gravity feed from the collector portion of the dispenser to the reservoir of the washing machine.

A symmetrically curved continuous screen member is mounted to the inner walls of the housing member at a position therealong defining the intersection of the upper storage portion and the lower collector portion of the housing member. The screen member is curved so as to appear concave with respect to the underlying collector portion and has a screen mesh sized to retainably carry powdered detergent thereabove within the upper storage portion. The screen member forms a snug fit with the inner walls of the housing member so as to prevent the passage of liquid therebetween. Spray forming nozzle means are axially mounted in the collector portion of the housing member and is disposed below the screen member in a position tangential and equidistant to all points of the screen member so as to direct a uniform spray at substantially the entire downwardly facing surface of the screen member. The relative positioning between the nozzle means and the screen member is such that the spray emanating from the nozzle means impinges generally perpendicularly upon the screen member across its entire downwardly facing surface.

The nozzle means are connected to a pressurized source of water by means of a water supply line. Spray control means including a valve in the water supply line controls the flow of water to the spray-forming nozzle. In operation, the valve normally blocks water flow to the nozzle and is operative in its open position only upon receipt of an external control signal. Upon receipt of such a control signal, water flow is directed through the supply line and the nozzle means and into engagement with substantially the entire lower surface of the screen member. Spray from the nozzle means is of relatively low pressure and wets only that portion of the powdered detergent carried immediately above the screen member. The wetted detergent passes in solution through the screen member and is directed by the underlying collector portion of the housing member to the outlet port thereof and through the conduit to the reservoir of the washing machine.

The control signal may be applied to the spray control means either manually, or automatically by means of an electronic control module. The electronic control module generally includes a conductivity cell disposed within the reservoir for sensing the conductivity/dilution of the detergent solution therein. When the conductivity of the detergent solution within the reservoir falls below a predetermined level, the electronic control module provides an energizing control signal to the spray control means for opening the valve in the water supply line. When a sufficient amount of concentrated detergent has been added to the reservoir, the conductivity cell indicates a satisfied condition and directs the electronic control module to remove the control signal from the spray control means, thus closing the water supply line.

A safety control switching circuit is connected to sense the operative position of the door member covering the access port to the housing member and prevents water spray from the nozzle whenever the door member is not secured in its closed position overlying the access port. Therefore, an operator cannot be injured by the spray of highly caustic matter while loading the dispenser apparatus.

While the present invention will be described in combination with a particular configuration of the dispenser housing member, it will be understood that other configurations could be designed within the spirit and intent of this invention. Further, while the preferred embodiment of the invention will be described in combination with specific electronic control modules for providing control signals to the spray control means regulating water flow to a spray nozzle, it will be understood that other control circuits could equally well be configured within the spirit and intent of this invention.

Similarly, while specific safety feature circuits and techniques will be described with respect to the preferred embodiments of this invention, other safety control means including purely mechanical linkage safety systems could equally well be devised within the scope of this invention which would render the dispensing apparatus non-hazardous to an operator of the device.

BRIEF DESCRIPTION OF THE DRAWING

Referring to the Drawing, wherein like numerals represent like parts throughout the severals views:

FIG. 1 is a view in front elevation with portions thereof broken away, of a powdered detergent dispenser constructed according to the principles of this invention;

FIG. 1*a* is a partial sectional view of the powdered detergent dispenser of FIG. 1, illustrating an embodiment thereof which employs a conically shaped screen member.

FIG. 2 is a view in side elevation of the powdered detergent dispenser disclosed in FIG. 1;

DESCRIPTION OF THE PREFERRED EMBODIMENTS

Figure 3:
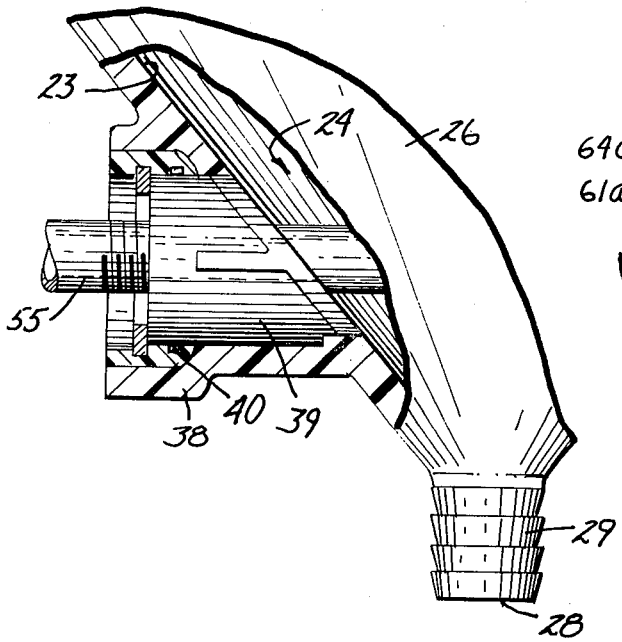
FIG. 3 is an enlarged fragmentary view with portions thereof broken away of the lower part of the collector portion of the dispenser apparatus disclosed in FIG. 1.

Referring to the Figures, there is generally disclosed at 20 a container or housing member. The housing member has a generally cylindrical upper storage portion 22 having a cylindrical inner wall 23. The wall 23 defines an internal cavity 24. The upper terminous of the storage portion 22 defines a mouth or access port 25 into the cavity 24 of the storage portion 22.

The inner wall 23 of the housing member 20 converges in the downward direction, defining a lower funnel-shaped collector portion 26 of the housing member 20. The inner wall 23 of the housing member 20 is configured to form an annular flange at 27 circumferentially extending around the inner wall 23 of the housing member 20 at the juncture of the upper storage portion 22 and the lower collector portion 26. The lower terminous of the collector portion 26 defines an outlet port 28 from the internal cavity 24 for passage therethrough of solution collected by the collector portion 26. The outlet port 28 has a hose clamp extension 29 having a plurality of annular ribs configured for engaging the inner walls of a connecting hose or conduit 30.

The container or housing member 20 may be constructed of any suitable material which is capable of withstanding exposure to highly caustic detergent solutions, and is preferably configured of stainless steel or molded plastic material. A pair of mounting plates 32 are connected to and extend rearwardly from the outer surface of the housing member 20 for securely mounting the housing member 20 to a vertical side wall, generally designated at 100 of a washing machine, schematically illustrated at 105 in FIGS. 5 and 6. A brace member 33 extends across the back surface of the housing member 20, connecting the pair of mounting plates 32 and adding structural support to the dispenser housing member 20.

A door member 34 is sized to extend entirely across and to sealingly close the mouth or access port 25 to the internal cavity 24 of the housing member 20. The door member 34 is pivotally mounted to the brace member 33 at 35 for pivotal motion between a closed position, illustrated in full line in FIGS. 1 and 2, to an open position, illustrated in dashed lines in FIG. 2. The lower collector portion 26 of the housing member 20 has an outwardly projecting coupling portion 38 extending from the collector portion 26 adjacent the outlet port 28 of the collector portion 26. A tube fitting insert member 39 is secured within the coupling projection 38 and projects through the inner wall 23 of the collector portion 26 of the housing member 20. A spray-forming nozzle 42 is threaded into the end of the tube insert 39 and is axially aligned within the inner cavity 24 of the housing member 20 in a direction so as to direct an upwardly projected spray pattern therefrom. The tube fitting insert member 39 is provided with an O-ring seal 40.

A screen member 50 symmetrically curved in a hemispherical or conical shape about (see FIG. 1*a*) the longitudinal axis of the internal cavity 24 is mounted in resting engagement upon the annular flanged portion 27 of the housing member 20. The curved screen member 50 includes a screen mesh 50*a* supportingly mounted over a wire frame support structure 50*b*. The mesh size of the screen 50*a* is sized so as to prevent powdered detergent from passing therethrough. The outer periphery of the screen member 50 extends beyond the inner edge of the flange portion 27 of the housing member 20 (when viewed from below). A retaining circular wire member 52 engages the upper portion of the screen member 50 about its periphery and is sized to frictionaly engage the inner walls 23 of the housing member 20 so as to retainably hold the screen member 50 into firm engagement with the flange portion 27. An upper extension 50*c* of the wire frame member 50*b* projects upwardly into the upper storage portion 22 of the container 20 and acts as a handle for enabling removal of the screen member 50 from the housing member 20 for maintenance and repair purposes.

The screen member 50 is curved in the direction so as to appear concave when viewed from the collector portion 26 of the housing member 20. The curvature of the screen member 50 with respect to the spray-forming nozzle 42 is such that the screen mesh 50*a* is tangential and substantially equidistant at all portions therealong from the center of the spray-forming nozzle 42. Similarly, the spray pattern emanating from the nozzle 42 is upwardly directed against the screen mesh 50*a* of the screen member 50 so as to substantially wet the entire surface area of the screen mesh 50*a*, and such that the spray impinges upon the screen mesh in a direction generally perpendicular thereto at all points therealong.

A water supply inlet pipe 55 is connected to the tube insert 39 and is in communication therewith for providing a source of water flow to the spray-forming nozzle 42. The water supply line 55 passes through one of the mounting plate members 32, as illustrated in FIGS. 1 and 2, and receives structural support therefrom. A siphon breaker 56 interrupts the water supply line 55.

Figure 4:
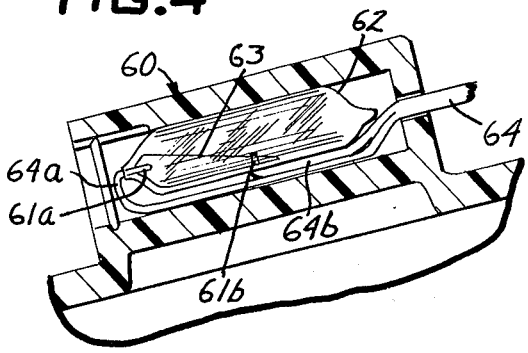
FIG. 4 is an enlarged sectional view of the safety control switch portion of the preferred embodiment of the dispenser apparatus disclosed in FIG. 1.

A safety switch 60 is mounted to the door member 34 for movement therewith and senses the operative position of the door member 34 relative to the mouth or access port 25 of the housing member 20. In the preferred embodiment, the safety switch 60 comprises a mercury actuated switch, diagrammatically illustrated in FIG. 4. Referring thereto, the switch 60 generally has a pair of contacts 61*a* and 61*b* projecting within an insulating bulb member 62 which entraps a fluid conductive medium 63 such as mercury. The switch 60 is mounted upon the door member 34 such that when the door member 34 is operatively positioned so as to close external access to the upper storage portion 22 of the housing member 20, the mercury 63 provides an electrical shorting path between the first and second terminals 61*a* and 61*b* of the switch 60, as illustrated in FIG. 4. When the door member 34 is pivotally open so as to enable access to the internal cavity 24 of the housing member 20, the mercury 63 flows within the bulb member 62 away from engagement with the first terminal 61*a* so as to break the electrical circuit path between the terminals 61*a* and 61*b*, thus electrically opening the switch 60. Conduction paths are provided from the first and second terminals 61*a* and 61*b* respectively of the switch 60 by means of a pair of conductor members 64*a* and 64*b* respectively.

Figure 5:
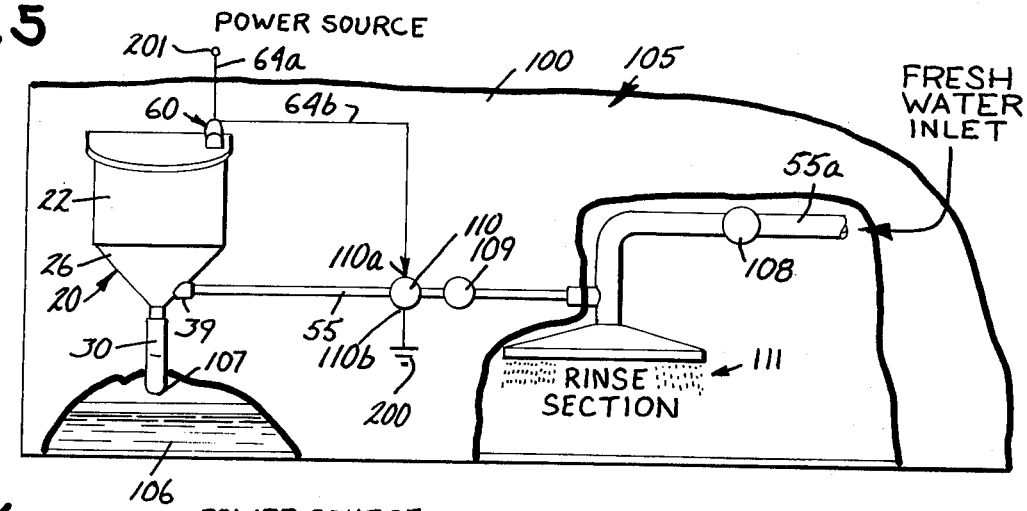
FIG. 5 is a schematic block diagram illustrating the circulartory and basic electrical signal flow paths of the dispensing system of one embodiment of this invention.

A block diagram of the circuit and fluid flow paths for the dispenser apparatus as connected within a hydraulic, manually controlled system is illustrated in FIG. 5. Referring thereto, the dispenser housing member 20 is illustrated as mounted to the side wall 100 of a washing machine, generally denoted at 105. The washing machine 105 has a wash tank or reservoir 106 for storing a supply of detergent solution for use within the machine. The hose or conduit 30 extends from the outlet port 28 of the housing member 20 and is connected to a hose clamp extension 107 (see FIG. 2) extending through the side wall 100 of the washing machine 105 and terminating at a position directly overlying the reservoir 106. The washing machine 105 also has a main fresh water supply line 55*a* connected to a pressurized source of water (not illustrated). The main water line 55*a* directly provides clean rinse water to the rinse section 111 of the machine and branches out to the water supply line 55 for providing fresh water to the spray-forming nozzle 42. A rinse valve 108, either manually or electronically controlled, is connected in the main water supply line 55*a* at a position upstream from the rinse head and upstream from the the input to the water supply line 55. A flow control valve 109 is connected in the water supply line 55 leading to the spray-forming nozzle 42 and regulates the rate of flow of water to the spray-forming nozzle 42. A safety control valve 110 is connected in the water supply line 55 either upstream or downstream from the flow control valve 109. The safety control valve 110 is, in the preferred embodiment, a solenoid actuated valve having an input control terminal 110*a* and a common terminal generally designated at 110*b*. The common terminal 110*b* is directly connected to a reference potential generally designated at 200.

The first conductor 64*a* leading from the safety switch 60 is directly connected to an appropriate power source 201. The second conductor 64*b* leading from the safety switch 60 is directly connected to the control input terminal 110*a* of the solenoid actuated safety control valve 110.

Figure 6:
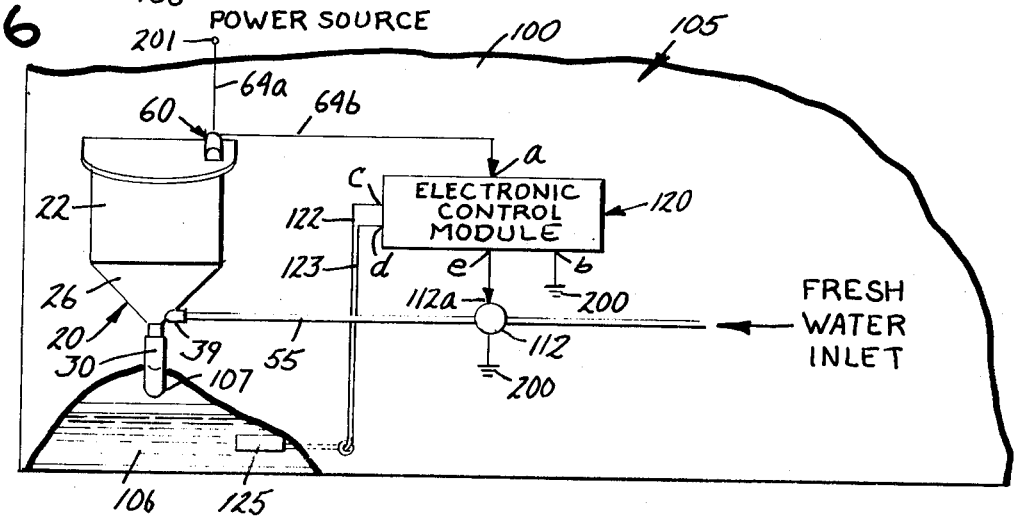
FIG. 6 is a schematic block diagram illustrating the circulatory and basic electrical signal flow paths of the dispensing system of a second embodiment of this invention.

A block diagram of the circuit and fluid flow paths for the dispenser apparatus as connected within an electronically controlled dispensing system is illustrated in FIG. 6. Referring thereto, the detergent dispenser housing member 20 is illustrated as mounted to the side wall 100 of the washing machine 105 at a position above the wash tank or reservoir 106 of the machine such that the conduit 30 and associated hose connecting extension 107 dispense the contents of the collector portion 26 of the housing member 20 directly into the reservoir 106. The water supply line 55 is directly connected to a source of pressurized water (not illustrated). A solenoid controlled valve 112 is connected in the water supply line 55 between the spray-forming nozzle 42 and the water supply source. The solenoid valve 112 has an input control terminal 112*a* and a common terminal 112*b* which is directly connected to a ground potential 200.

The first conductor 64*a* leading from the safety switch 60 is directly connected to the power source 201. While not disclosed, it will be understood that the power source 201 may represent any appropriate source of electrical power suitable for energizing the electronic components described herein. Similarly, while not illustrated, it will be understood that the water supply source may be any fluid supply source capable of continuously directing a flow of water under pressure through the water supply lines 55 and 55*a*.

The second conductor 64*b* leading from the safety switch 60 is connected to a positive power supply input terminal 120*a* of an electronic control module 120. The electronic control module 120 further has a reference supply input terminal 120*b* which is directly connected to the common potential 200, a first signal input terminal 120*c*, a second signal input terminal 120*d* and a signal output terminal 120*e*. The signal output terminal of the electronic control module 120 is directly connected to the control input terminal 112*a* of the solenoid valve 112. The first and second signal input terminals 120*c* and 120*d* respectively of the electronic control module 120 are directly connected by means of a pair of signal flow paths 122 and 123 respectively to the terminals of a conductivity cell 125. The conductivity cell 125 is mounted within the reservoir 106 of the washing machine 105 for sensing the electrical conductivity of the solution contained therein.

In the preferred embodiment, the electronic control module 120 may be functionally identical to that of the electronic control network described in U.S. Pat. No. 3,680,070 to Marcus I. Nystuen, owned by the common assignee of this invention. In general, the electronic control module 120 is normally operable to provide a de-energizing signal output at its output terminal 120*e* when the conductivity cell 125 indicates that the conductivity (i.e. the detergent concentration level) of the detergent solution within the wash tank or reservoir 106 is at or above a predetermined level and is operable to produce an energizing output signal at its signal output terminal 120*e* whenever the conductivity cell 125 indicates that the conductivity (concentration level) of the solution within the reservoir 106 has dropped below a predetermined minimum level. The signal output appearing at the output terminal 120*e* of the electronic control module is used to energize the input control terminal 112*a* of the solenoid valve 112. The circuits within the electronic control module 120 are energized from the power source 201 by means of the serially connected safety switch 60. Therefore, whenever the safety switch is operative in a non-conducting (open) mode, the electronic control module circuits will be disabled, preventing passage of an energizing signal to the solenoid valve 112, regardless of the conductivity indication status of the conductivity cell 125.

The conductivity cell 125 may be of any type of such cell well known in the art, which provides an electrical output signal that varies in response to the electrical conductivity of the solution in which it is immersed.

It will be understood that other configurations for the electronic control module 120 could be designed within the spirit and scope of this invention. For example, the electronic control module 120 could also comprise those circuits detailed in the electronic control network described in U.S. Pat. No. 3,879,675 to Marcus I. Nystuen et al, owned by the common assignee of this invention. The electronic control apparatus of this alternate embodiment energizes the conductivity cell 125 by means of short periodic pulses of DC current to avoid polarization of the cell, and is particularly useful for higher concentrations of electrolyte solutions.

OPERATION OF THE PREFERRED EMBODIMENT

Operation of the dispensing apparatus of this invention is relatively simple and is briefly described below. A mass of powdered detergent is loaded into the upper storage portion 22 of the housing member 20 through the upper mouth or access port 25. To load the dispenser apparatus the door member 34 must be lifted to an upright position as indicated in dashed lines in FIG. 2. The powdered detergent is retainably carried by the curved screen member 50 above the spray-forming nozzle 42. In the preferred embodiment, the housing member 20 will typically hold 8 pounds of powdered detergent but can be readily sized to hold up to 15 pounds of powdered detergent; however, it will be understood that other sizes could equally well be configured within the scope of this invention.

When the member 34 is raised out of sealing engagement overlying the access port 25, the mercury 63 within the safety switch 60 will be disposed within the bulb portion 62 of the safety switch 60 (see FIG. 4) so as to electrically open the signal path between the first and second terminals 61*a* and 61*b* respectively of the safety switch 60. With respect to the hydraulic application of the invention (FIG. 5) the solenoid valve 110 is connected so as to be positioned in an open position, enabling fluid flow through the water supply line 55 when in receipt of an energizing signal from the safety switch 60. However, when signal flow to the solenoid valve 110 is blocked by means of the safety switch 60, the solenoid valve 110 will close, blocking further fluid flow to the spray-forming nozzle 42. In the apparatus disclosed in FIG. 5, under normal operation, a fluid flow path is established from the water source through the water supply line 55 to the spray-forming nozzle 42 whenever the rinse valve 108 is opened, either electronically or manually. When provided with fluid flow therethrough, the spray-forming nozzle will direct a spray pattern at the bottom surface of the screen mesh 50*a* of the screen member 50, wetting that detergent carried immediately thereabove, which dissolves and passes in solution through the screen mesh to the collector portion of the housing member 20. Thus, concentrated detergent solution is produced in this arrangement of the apparatus, whenever the rinse valve 108 is opened and the door member 34 is closed so as to enable the safety switch 60. The concentrated detergent solution passes through the outlet port 28 of the housing member 20 and is directed by the hose or conduit 30 into the reservoir 106 of the washing machine 105.

In that configuration of the invention disclosed in FIG. 6, the electronic control module 120 is enabled by means of the safety switch 60 whenever the door member 34 is closed in its downward position over the access port 25 to the housing member 20. The solenoid valve 112 is operative to normally block flow of water through the water supply line 55 in the absence of receipt of an energizing signal at its signal input terminal 112*a*. The conductivity cell 125 measured the conductivity of the solution within the reservoir 106 of the washing machine 105. As the detergent solution within the reservoir 106 is diluted during washing or rinsing operations, the conductivity of the detergent solution will drop. When the conductivity of the detergent solution in the reservoir drops below a predetermined threshold level, the conductivity cell 125 communicates this information by means of the signal flow paths 122 and 123 to the electronic control module 120. If enabled by means of the safety switch 60, the electronic control module 120 will produce an energizing output signal at its signal output 120*e* for energizing the solenoid valve 112. Upon receipt of an energizing signal, the solenoid valve 112 will open, allowing water to flow through the water supply pipe 55 for producing a spray at the spray-forming nozzle 42. The spray thus produced will continuously dissolve that powdered detergent immediately adjacent the screen member 50, which passes in solution as above described into the reservoir 106. When a sufficient amount of concentrated detergent solution has been added to the reservoir so as to re-establish the predetermined conductivity level therein, the conductivity cell 125 communicates this information to the electronic control module 120 which removes the enabling output signal from its signal output terminal 120*e*, thus disabling the solenoid valve 112. If for any reason an operator should move the door member 34 from its downward position while the solenoid valve 112 is open, the safety switch 60 will disable the electronic control module, effecting a disabling of the solenoid valve 112 and immediately closing the water supply line 55. Thus an operator is always protected from hazardous spray of highly cautic detergent solutions which can be severely damaging to his face and eyes.

The housing member of this invention need not be mounted on top the washing machine, and can be positioned on the side wall 100 of the washing machine 105 at a height above the solution level within the reservoir 106, which is conveniently accessible to an operator for loading operations. The side mounting feature of this invention also provides additional safety to the operator by providing increased distance between the operator's face and the inlet port to the dispenser housing member, thus minimizing the possiblity of hazardous splash to the operator face when lifting the door member 34. Further, the unique screen and spray nozzle configuration of this invention renders this dispenser apparatus particularly attractive for use with powdered detergents containing active chlorine due to the minimization of wetting of the powdered detergent and the absence of channeling therethrough.

Other modifications of the invention will be apparent to those skilled in the art in light of the foregoing description. This description is intended to provide concrete examples of individual embodiments clearly disclosing the present invention. Accordingly, the invention is not limited to these embodiments or to the use of specific elements therein. All alternative modifications and variations of the present invention which fall within the spirit and broad scope of the appended claims are covered.

What is claimed is:

1. Improved powder detergent dispenser apparatus for attachment to or closely adjacent a washing machine, wherein the washing machine is of the type having a reservoir for maintaining a supply of concentrated detergent solution, comprising:

a. a container for powdered detergent, comprising:
   i. an upper storage portion for retainably holding a mass of powdered detergent, defining an upwardly disposed mouth for accepting the detergent therethrough into said storage portion;
   ii. a door member pivotally hinged to said container and disposed across said upwardly disposed mouth, said door member being movable with respect to said upwardly disposed mouth to open and close detergent loading access to said storage portion therethrough;
   iii. a funnel shaped collector portion integral with and extending continuously downward from said storage portion and terminating at a lower outlet port from the container; and
   iv. a support member extending from the inner wall of the container at the juncture of said storage and said collector portions thereof, having an annular flange extending inwardly toward the center of the container;

b. means for mounting said container to a vertical wall proximate to a washing machine;

c. a symmetrically curved continuous screen member mounted within said container on said support flange, said screen member being concave when viewed from the underlying collector portion and having a screen mesh sized to retainably carry a powdered detergent thereabove;

d. spray-forming nozzle means mounted in the collector portion of said container below said curved screen member for directing a uniform spray at substantially the entire downwardly facing surface of said screen member such that said spray impinges generally perpendicularly upon said screen member across its entire surface;

e. a conduit connecting said outlet port with the washing machine for directing by gravity flow concentrated detergent solution from the collector portion of said container into a reservoir of the washing machine;

f. a water supply line connecting said spray nozzle with a pressurized source of water;

g. spray control means cooperatively connected to said water supply line for selectively controlling flow of water through said supply line to said nozzle means and being operative in response to receipt of a control signal to open said water supply line to water flow therethrough, causing said nozzle means to direct a spray of water against the lower surface of said screen member, dissolving that detergent carried immediately thereabove which passes in solution through the screen member to the underlying collector portion of said container, and is immediately directed by said collector portion through said outlet port thereof to said conduit; and h. safety control switching means responsive to movement of said door member to immediately blocking water spray from said nozzle means whenever said door member is moved from a closed position overlying the mouth of said container to prevent spray of caustic solution through said container mouth.

2. A powdered detergent dispenser apparatus as recited in claim 1, including retaining means for firmly holding said screen member in engagement with said support flange, and wherein said support flange projects from the inner wall of said container in a manner so as to prevent water sprayed from said nozzle means from passing between said support member and the inner wall of said container and into said storage portion.

3. A powdered detergent dispenser apparatus as recited in claim 1, wherein said safety control switching means comprises:

a. an electrically actuated safety valve in said water supply line, normally operable in response to receipt of a first electrical signal to allow free flow of water through said supply line and responsive to receipt of a second electrical signal to block the flow of water through said water supply line; and b. electronic switching means operatively connected with said safety valve for sensing the operative position of said door member and for selectively producing in response thereto said first and said second electrical signals, said electronic switching means being normally operative when said door member is operatively disposed in a closed position over the mouth of said container to produce said first electrical signal, and being operable in response to movement of said door member away from its said closed position to produce said second electrical signal, causing said safety valve to close.

4. A powdered detergent dispenser apparatus as recited in claim 3, wherein said electronic switching means includes a position sensitive switch member mounted for movement with said door member.

5. A powdered detergent dispenser apparatus as recited in claim 4, wherein said position sensitive switch member comprises a mercury switch.

6. A powdered detergent dispenser apparatus as recited in claim 1, wherein said washing machine is further characterized by a rinse supply conduit in fluid communication with the water source and comprising in part said water supply line, and wherein a valve is positioned within the rinse supply conduit for controlling the flow of rinse water to the washing machine.

7. A powdered detergent dispenser apparatus as recited in claim 1, wherein said spray control means includes an electrically actuated valve normally operative in response to receipt of a first electrical signal to block flow of water through said water supply line to said nozzle means, and responsive to receipt of a second electrical signal to open said water supply line to water flow therethrough; and wherein said dispenser apparatus further includes electronic control means cooperatively connected with said electrically actuated valve and having a conductivity sensing member mounted within the reservoir for sensing the conductivity of a detergent solution within the reservoir and for selectively producing said first and said second electrical signals in response thereto, said electronic control means being normally operative to produce said first electric signal when the detergent concentration within the reservoir is above a predetermined level, and being operative to produce said second electric signal whenever the detergent concentration within the reservoir falls below the predetermined level.

8. A powdered detergent dispenser apparatus as recited in claim 7, wherein said safety control switching means is operatively connected in circuit with said electrically actuated valve, and includes means for overriding any said first electrical signals produced by said electronic control means and for applying said second electrical signal to said electrically actuated valve, whenever the door member is not closed, thus blocking spray from said nozzle.

9. A powdered detergent dispenser apparatus as recited in claim 1, wherein said spray-forming nozzle means comprises a single spray-forming nozzle axially mounted in the collector portion of said container below said screen member.

10. A powdered detergent dispenser for mounting to said side wall of a washing machine, comprising:

a. a housing member configured for mounting to a vertical side wall of a washing machine, having an inner wall symmetrically disposed about a longitudinal axis and defining a substantially enclosed inner cavity, said housing member having access and discharge ports formed there through opening into said cavity from oppositely disposed upper and lower ends respectively thereof, said inner wall continuously extending between said access and said discharge ports;

b. a continuous screen member mounted to said inner wall within the cavity of said housing member in a manner forming a continuum between said screen member and said inner wall for preventing liquid passage therebetween around the perimeter of said screen member, said screen member being concave when viewed from the lower portion of said housing member and having a mesh sized to retainably carry a mass of powdered detergent introduced into said cavity through said access port thereabove;

c. spray-forming nozzle means mounted to said housing and extending into said cavity thereof below said screen member for directing a uniform spray of water at substantially the entire downwardly facing surface of said screen member in a direction generally perpendicular thereto at all positions therealong;

d. closure means connected to said housing member at said upwardly disposed access port thereof for selectively closing and opening said access port for loading powdered detergent into the cavity of said housing member;

e. water supply conduit means operatively connecting said nozzle means to a pressurized water source for delivering a flow of water to said nozzle means, said water passing as a spray through said nozzle means and against said screen member, wetting that detergent carried immediately thereabove, which detergent passes in solution through the screen member into the lower cavity portion of the housing member, said lower cavity portion being configured to immediately direct said detergent solution toward said discharge port of said housing member;

f. valve means connected in said water supply conduit means and responsive to an externally received control signal for selectively blocking the flow of water to said nozzle means through said conduit means; and g. conduit means connected to the dicharge port of the housing for directing under gravity flow, the concentrated detergent solution produced by said nozzle means and screen, external of said dispenser housing member.

11. A powdered detergent dispenser as recited in claim 10, including control switching means responsive to movement of said closure means in a direction so as to open said access port, for blocking water spray from said nozzle means whenever said closure means is disposed in a position so as to enable external access to said internal cavity through said access port.

12. A powdered detergent dispenser as recited in claim 10, wherein said valve means includes an electrically actuated valve connected in said water supply conduit means, said valve being normally operative to block the flow of water to said nozzle means through said conduit means and being operable when in receipt of a first electrical signal to open the fluid flow path through said conduit means to said nozzle means; and wherein said dispenser apparatus comprises electronic control means connected to energize said electrically actuated valve, for sensing detergent solution demand requirements of a washing machine and for selectively producing said first electrical signal in response thereto.

13. A powdered detergent dispenser as recited in claim 10, wherein said nozzle means comprises a single spray-forming nozzle mounted to said housing and extending into said cavity thereof below said screen member at a position such that said nozzle is disposed generally tangentially to and is equidistant from substantially all portions of the lower surface of said curved screen member, said nozzle being configured to direct a uniform spray of water at substantially the entire downwardly facing surface of said screen member in a direction generally perpendicular thereto at all positions therealong.

14. A powdered detergent dispenser as recited in claim 10, wherein said screen member comprises a hemispherically shaped screen member, being symmetrically disposed about the longitudinal axis of said housing member with its vertex extending toward the upper portion of said housing.

15. A powdered detergent dispenser as recited in claim 10, wherein said screen member comprises a conically shaped screen member, being symmetrically disposed about the longitudinal axis of said housing member with its apex extending toward the upper portion of said housing.

* * * * *